United States Patent [19]

Lindfors et al.

[11] Patent Number: 4,488,084

[45] Date of Patent: Dec. 11, 1984

[54] ELECTROLUMINESCENCE STRUCTURE

[75] Inventors: Sven G. Lindfors; Jorma O. Antson, both of Espoo; Ralf Graeffe, Porvoo; Arto J. Pakkala, Evitskog; Tuomo S. Suntola, Espoo, all of Finland

[73] Assignee: Oy Lohja Ab, Virkkala, Finland

[21] Appl. No.: 251,087

[22] Filed: Apr. 6, 1981

[30] Foreign Application Priority Data

Apr. 24, 1980 [FI] Finland ..... 801318

[51] Int. Cl.[3] ..... H01J 29/28; H01J 1/70

[52] U.S. Cl. ..... 313/506; 313/463

[58] Field of Search ..... 313/506, 505, 463, 509, 313/510; 427/66; 204/192 P

[56] References Cited

U.S. PATENT DOCUMENTS

| | | | |
|---|---|---|---|
| 3,087,085 | 4/1963 | Turner | 313/463 X |
| 3,560,784 | 2/1971 | Steele et al. | 313/474 X |
| 3,908,148 | 9/1975 | Lehrer et al. | 313/463 X |
| 4,143,404 | 3/1979 | Armstrong et al. | 313/463 |

OTHER PUBLICATIONS

Gerber et al., IBM Technical Disclosure Bulletin; vol. 20, #4, Sep. 1977; p. 1561.

*Primary Examiner*—David K. Moore
*Assistant Examiner*—K. Wieder
*Attorney, Agent, or Firm*—Fitzpatrick, Cella, Harper & Scinto

[57] ABSTRACT

Disclosed herein is an electroluminescence structure comprising, in sandwich arrangement, a transparent substrate made of, e.g., glass, a first transparent electrode layer, a luminescence layer, a number of second transparant electrode layers disposed at least partially on the luminescence layer, and a black layer arranged in contact with the luminescence layer and the second electrode layer. The black layer covers the second electrode layer and is in contact with the luminescence layer outside of said second electrode layers. The black layer consists of an insulating layer and a wiring disposed on said insulating layer. Openings reaching the second elctrode layer are defined in the insulating layer opposite said second electrode layers such that the wiring can make electrical contact with the second electrode layers through the openings.

4 Claims, 3 Drawing Figures

ELECTROLUMINESCENCE STRUCTURE

This invention relates to an electroluminescence structure comprising at least one transparent substrate made of, e.g., glass, at least one first transparent electrode layer disposed on the substrate, a luminescence layer disposed on the first electrode layer.

at least one second electrode layer disposed at least partially on the luminescence layer, and at least one black layer arranged in contact with the luminescence layer and the second electrode layer.

In the prior art, electroluminescence films are known which have been manufactured by using the so-called thin film technique. Since a luminescence film manufactured by using the thin film technique is transparent, the structure can be provided with a black background in order to improve the contrast. Such a structure has been presented, e.g., in the U.S. Pat. No. 3,560,784. In the prior art structure the black layer is disposed between the second electrode layer and the luminescence layer. In this way a black background is achieved irrespective of the type of back electrode. A drawback of this structure is the fact that the black layer will have to remain under the influence of an electric field, which creates stability problems.

On the other hand, the black layer has to be insulating in order to prevent currents between adjacent electrodes at different potentials.

An additional problem has been the difficulty to find stable, black thin film insulating materials.

In the IBM Technical Disclosure Bulletin, Volume 20, No. 4, September 1977, there is disclosed a structure in which the electrode itself is black. This has been achieved by using black conductive materials known from the so-called thick film technique. Characteristic of these materials is that in these the conductivity has been realized by using conductive particles, whereby the luminescence film emits light only at those points where such a conductive particle touches the surface of the film. The particles in question can be mixed with the electrode material.

The object of this invention is to eliminate the drawbacks of the above prior art structures and to create an electroluminescence structure of an entirely new type.

The invention is based on the idea that the electrical wiring to the transparent second electrodes is accomplished through openings or border areas in the thick film layer forming the black background.

In more accurate terms, the electroluminescence structure according to the invention is characterized in that the second electrode layer is transparent, and the black layer covers the second electrode layer and is in contact with the luminescence layer outside of said second electrode layer.

By means of the invention considerable advantages are achieved. So, for instance, the choice of the black material is more independent as this material will not be subjected to an electric field. Hence, this material can consist of, e.g., some organic thick film material. This material can at the same time also function as a protective layer. As an example, black silicon can be mentioned. Although the transparent electrode is situated under an inhomogeneous thick film, the inhomogeneity of the thick film does not influence the homogeneity of the light emission.

Besides, the transparence of the second electrode layer (rear electrode) imparts to the structure a more general utilization possibility than the prior art structures. Hence, several structures can be piled on top of each other to form a stack, whereby only the rearmost structure is provided with a black layer.

The invention will be examined in more detail in the following, reference being made to the embodiments according to the enclosed drawing.

Figure 1:
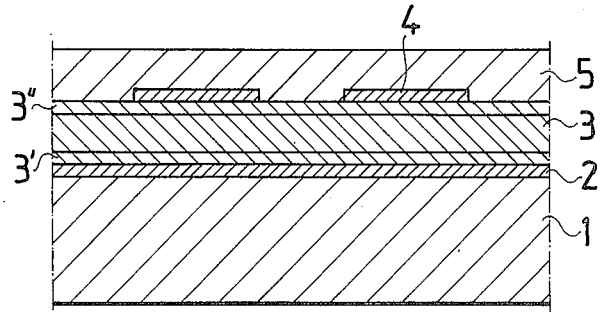
FIG. 1 is a sectional and partially diagrammatic view of one embodiment according to the invention.

The structure according to FIG. 1 comprises a transparent substrate 1 made of, e.g., glass and, disposed thereon, a first electrode layer 2 which is likewise transparent. An electroluminescence layer 3, 3', 3'' known per se has been disposed on the first transparent electrode layer 2. Several adjacent electrode layers 4 have been disposed on said electroluminescence layer 3, 3', 3'' in accordance with the configuration desired. The layers 2, 3', 3, 3'', and 4 can all be formed by utilizing thin film technology, e.g., the so-called Atomic Layer Epitaxy (ALE). The black layer comprises an insulating layer 5 covering the second electrodes 4 and contacting the luminescence layer 3 outside of said electrodes 4.

The embodiment according to FIG. 1 is applicable where all necessary conductors can be brought up to the edges of the component for contacting purposes. This is the case in, e.g., matrices with a relatively low resolution.

Figure 2:
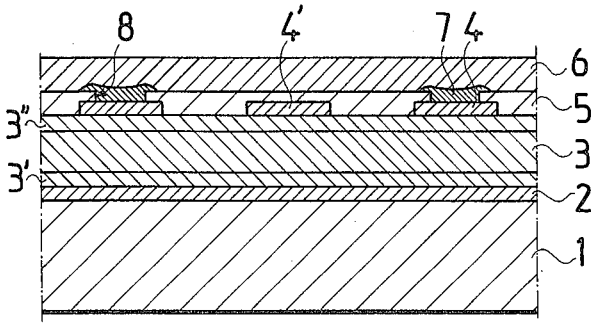
FIG. 2 is a sectional and partially diagrammatic view of a second embodiment of the invention.

The structure according to FIG. 2 differs from that according to FIG. 1 in that the black layer 5, 6, consists, on one hand, of an insulating layer 5 covering the second electrode layer 4 and contacting the electroluminescence layer 3, 3', 3'' outside of said second electrode layer 4 and, on the other hand, of a wiring 6 disposed on said insulating layer 5 and manufactured by using a thick film or thin film technique. Opposite each second electrode 4, the black layer 5 is provided with an opening reaching said second electrode layer 4. From the wiring 6, "protrusions" extend through the openings 8 in order to connect the wiring 6 electrically with the desired second electrodes 4. Such a "protrusion" 7 can be accomplished, e.g., by printing a black conductive area entirely covering the opening 8.

In materials with a high resolution, the conductivity of the upper electrode becomes more critical. In such a case the embodiment according to FIG. 2 is applicable. The structure allows the cross-over of an electrically separate figure element (e.g., 4' in FIG. 2). In addition the structure allows the use of thinner conductive stripes, e.g., for contacting several seven-segment figures such that corresponding segments are electrically interconnected.

Figure 3:
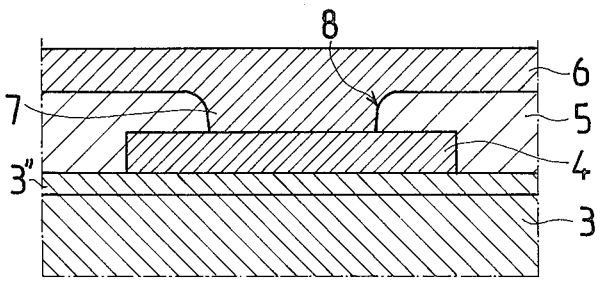
FIG. 3 is a sectional and partially diagrammatic view on an enlarged scale of a third embodiment according to the invention.

If the wiring 6 is entirely made of black material (FIG. 3), no separate conductive areas 7 are necessary. The structure according to FIG. 3 is a preferred embodiment in display devices with a relatively low resolution where the configuration of the electrode requires cross-overs. For instance, a seven-segment figure can be contacted by using a structure according to FIG. 3 such that the central segment is contacted over, e.g., an upper or lower electrode.

It should be mentioned that the insulating black thick film layer 5 of the structure according to FIG. 1 can be, in principle, made of any light absorbing thick film material or, as realized by means of thin film technique, for instance, an $Al_2O_3/Al$ alloy, arsenic sulfide, or arsenic selenide. Such layers can be manufactured by means of thick film or thin film processes known per se.

The layer 5 in FIGS. 1, 2 and 3 is an insulating polymer film containing black pigment known per se. One suitable raw material is commercially available as a curable paste from the Electro-Science Laboratories, Inc., Pennsauken, N.J., under the type denomination ESL 240-SB.

The layer 6 in FIG. 2 is a metal-filled conductive polymer film known per se. One suitable raw material is commercially available as a screen printable, silver-filled, one component material from the Electro-Science Laboratories, Inc. under the type denomination ESL 1109-S.

The conductive areas 7 in FIG. 2 and the layer 6 in FIG. 3 are carbon-filled, conductive polymer films known per se. One suitable raw material is commercially available as a curable paste from the Electro-Science Laboratories, Inc. under the type denomination RS-150-12. The wiring 6 can be realized, e.g., as an Al metallization.

It should be observed that both electrode layers 2 and 4 are transparent. They can be, e.g., sputtered ITO (Indium Tin Oxide) layers.

The luminescence layer 3, 3', 3'' is a sandwich structure comprising a light emitting layer 3 known per se, usually a ZnS:Mn layer, and current limiting auxiliary layers 3' and 3'' which are typically made of some metal oxide.

It should be observed that the expression "black layer" in this specification means a light absorbing layer in general, which layer can also have a colouring differing from black.

We claim:

1. An electroluminescence structure comprising:

(a) at least one transparent substrate made of, e.g., glass;

(b) at least one first transparent electrode layer disposed on the substrate;

(c) a luminescence layer disposed on the first electrode layer and extending in the lateral direction to cover the said first electrode layer;

(d) at least one second transparent electrode layer disposed at least partially on the luminescence layer;

(e) at least one black layer having at least one insulating portion covering at least opposite edge areas of the second electrode layer and reaching, in the lateral direction, beyond the second electrode layer so as to directly contact the luminescence layer outside of said second electrode layer; and (f) wiring disposed on said insulating portion, wherein at least one opening reaching the second electrode layer is formed in the insulating portion opposite said second electrode layer such that the wiring can make electrical contact with the second electrode layer through the opening.

2. An electroluminescence structure as claimed in claim 1, wherein the black layer is made of an electrically insulating material.

3. An electroluminescence structure as claimed in claim 1, wherein the wiring, at least in the area opposite the opening, is made of a black material.

4. An electroluminescence structure as claimed in claim 3, wherein the wiring is entirely made of a black material.

* * * * *